United States Patent [19]

Okumura et al.

[11] Patent Number: 5,010,737

[45] Date of Patent: Apr. 30, 1991

[54] MULTI-HEADED CRYOPUMP APPARATUS

[75] Inventors: Nobuo Okumura, Toyota; Atsuyuki Miura, Hazu, both of Japan

[73] Assignee: Aisin Seiki Kabushiki Kaisha, Kariya, Japan

[21] Appl. No.: 501,778

[22] Filed: Mar. 30, 1990

[30] Foreign Application Priority Data

Mar. 30, 1989 [JP] Japan ..... 1-080560

[51] Int. Cl.[5] ..... F25B 9/00

[52] U.S. Cl. ..... 62/6; 62/55.5

[58] Field of Search ..... 62/6, 55.5

[56] References Cited

U.S. PATENT DOCUMENTS 4,485,631 12/1984 Winkler ..... 62/55.5

4,614,093 9/1986 Bachler et al. ..... 62/55.5

4,679,401 7/1987 Lessard et al. ..... 62/55.5

4,757,689 7/1988 Bachler et al ..... 62/55.5

*Primary Examiner*—Ronald C. Capossela

*Attorney, Agent, or Firm*—Banner, Birch McKie & Beckett

[57] ABSTRACT

A multi-headed cryopump apparatus includes a plurality of cryopumps driven by a common compressor. There is a valve system between each cryopump and the compressor. A motor is provided for driving each cryopump, and a sensor is provided for detecting the amount of current supplied to each motor. By use of a control system, which accepts input from the sensors, the valve systems are controlled such that they operate in turn with a constant cycle.

3 Claims, 4 Drawing Sheets

| | | |

MULTI-HEADED CRYOPUMP APPARATUS

BACKGROUND OF THE INVENTION

1. Field of the Invention

The present invention relates to a multi-headed cryopump apparatus in which plural cryopumps are driven by a common compressor.

2. Description of the Prior Art

A multi-headed cryopump apparatus of the conventional type is disclosed, for example, in Japanese Laid-Open Patent Application No. 63-57881. In this conventional apparatus, an encoder for detecting the operating position of each cryompump, which is driven according to Gifford-McMahon cycle, is employed for assuring equal supply of the operating fluid effectively to each cryopump. This is accomplished even through each opening of the valve of each cryopump brings a temporary decrease in compression-ratio, which has an effect on the entire system. The position of the motor which controls a cam-operated valve or the condition of the valve itself is detected by the encoder for controlling the current to the motor by a control unit. The control unit responds to the signals from the encoder so that while one of the cryopumps is in its in-take stroke for intaking operating fluid under a high pressure, no other cryopump is in its in-take stroke.

However, in the conventional apparatus, the encoder has to be equipped in each cryopump, thereby requiring considerable modification of each cryopump at a high cost. In addition, such modification requires that cables be interposed between each cryopump and the control unit, whereby it is difficult to establish a remote-control system for the whole apparatus.

SUMMARY OF THE INVENTION

It is, therefore, a principal object of the present invention to provide a multi-headed cryopump apparatus without the foregoing drawbacks.

In order to attain this object, a multi-headed cryopump apparatus is comprised of a plurality of cryopumps, a common compressor connected to the cryopumps, a plurality of valve means, one interposed between each cryopump and the compressor, a plurality of motors each driving a corresponding cryopump, a plurality of current detecting sensors, each detecting the current supplied to a corresponding motor, and a control unit for controlling the operation of each valve means on the basis of the result of each current detecting sensor in such manner that the plural valve means operate in turn with a constant cycle.

In a cryopump apparatus having the foregoing construction or structure, the following operation is performed. A motor for driving each cryopump is rotated at a constant speed in synchronization with the cycle of a current of the power supply. The load of the motor varies during each revolution or rotation in response to the change in the stroke of each cryopump. Thus, the foregoing structure allows the detection of the position of each cryopump by detecting the current. The maximum current is equivalent to the intake stroke of each cryopump. If the maximum current is set to appear in turn with a constant cycle by the control unit, the operating fluid can be fed to each cryopump evenly and effectively.

BRIEF DESCRIPTION OF THE DRAWINGS

Additional objects and advantages of the present invention will become more apparent from the following detailed description of a preferred embodiment thereof when considered with reference to the attached drawings, in which.

DETAILED DESCRIPTION OF PREFERRED EMBODIMENT

Figure 1:
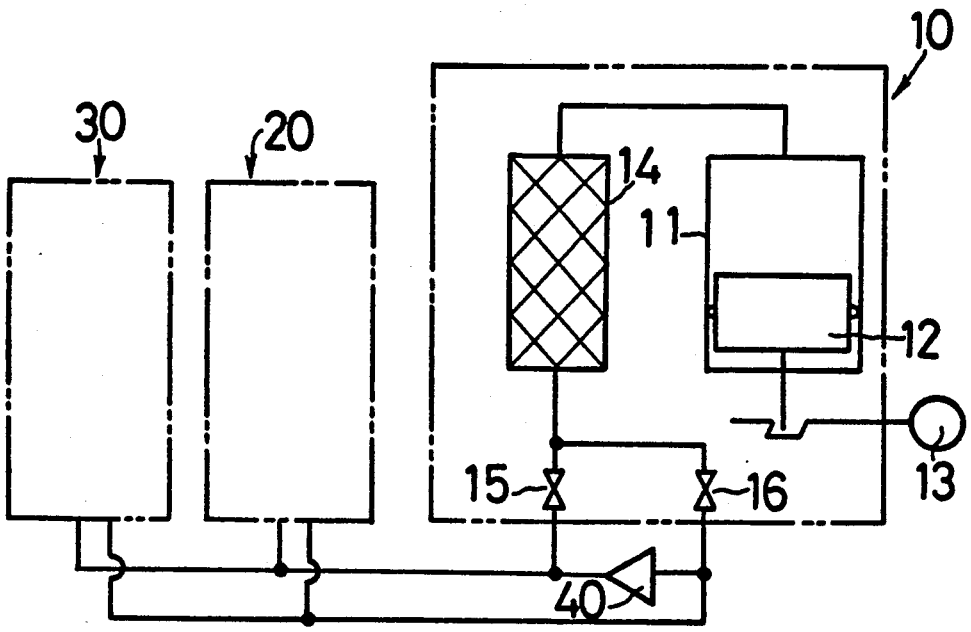
FIG. 1 is a simplified diagram of a multi-headed cryopump apparatus in accordance with one embodiment of the present invention.
Figure 2:
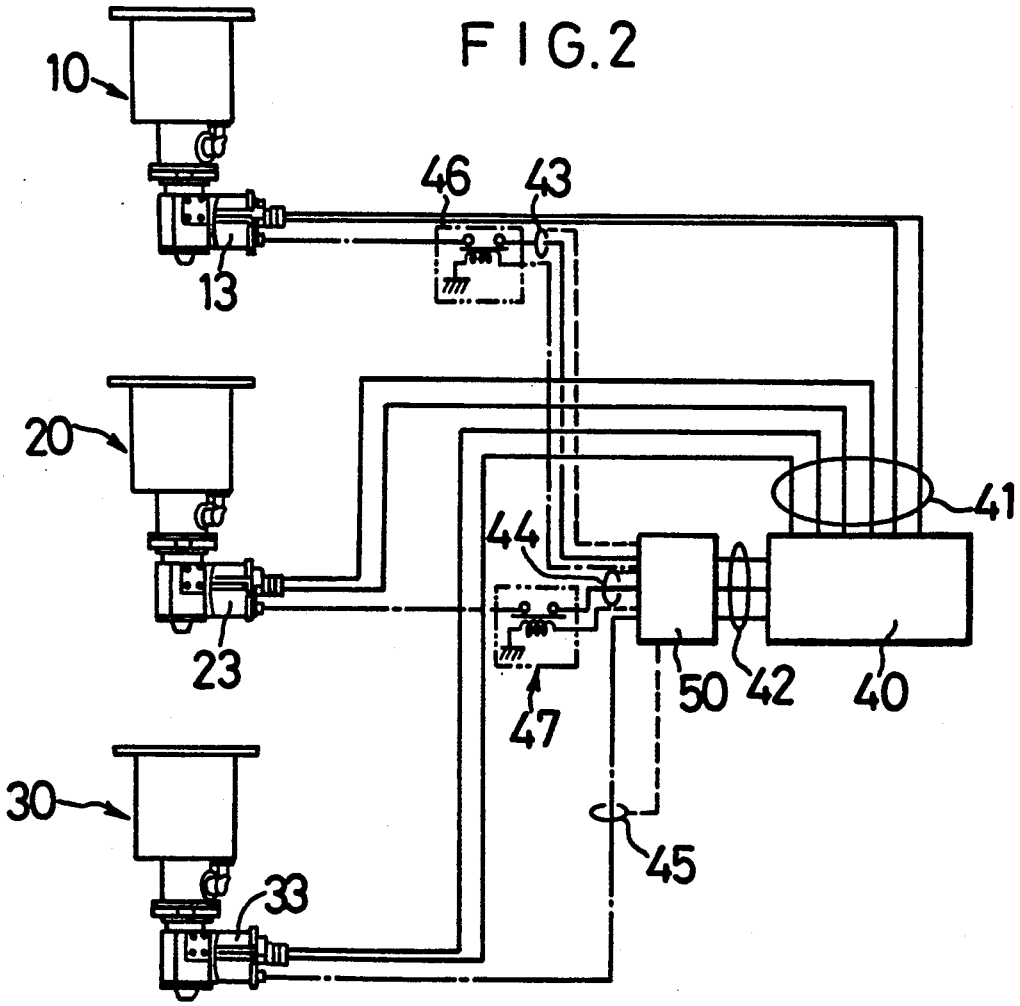
FIG. 2 is a detailed diagram of a multiple-headed cryopump apparatus in FIG. 1.

Referring now to FIGS. 1 and 2, there is illustrated an embodiment of a multi-headed cryopump according to the present invention which includes a first cryopump 10, a second cryopump 20, a third cryopump 30, and a common compressor 40 for driving the foregoing three cryopumps 10, 20 and 30, each of which operates in a Gifford-McMahon cycle. In FIG. 1, the cryopump 10 has an expansion cylinder 11 for generating refrigeration by expanding the operating fluid therein adiabatically, an expansion piston 12 which is reciprocably fitted within the cylinder 11, an electrically operated motor 13 for driving the piston 12, a regenerator 14 which is interposed between the cylinder 11 and the compressor 40 for heat-exchanging the operating fluid, a high-pressure valve 15 interposed between a discharge port of the compressor 40 and the regenerator 14, and a low-pressure valve 16 interposed between an intake port of the compressor 40 and the regenerator 14. Both valves 15 and 16, which constitute a valve means, are operated in response to the movement of the piston 12. It should be noted that the remaining cryopumps 20 and 30 include respective constructions each of which are similar to that of the first cryopump 10.

Under the foregoing construction, in each cryopump 10/20/30, the piston 12/22 (not shown)/32 (not shown) is brought into movement from its upper dead point to its lower dead point. Immediately upon turn-on of the motor 13/23/33, the high-pressure valve 15 is opened and the operating fluid from the compressor 40 is introduced to the cylinder 11/21 (not shown)/31 (not shown) after being cooled down to a temperature at the regenerator 14. Thereafter, the high-pressure valve 15 is closed and the low-pressure valve 16 is opened. Then, the operating fluid is sucked in a space in the cylinder 11 called an expansion space. At this time, the expansion space is expanded adiabatically, thereby generating the refrigeration. After the downward movement of the piston 12, the high-pressure valve 15 is opened and the low-pressure valve 16 is closed. Then, the operating fluid is heat-exchanged in the regenerator with the cooling air stored therein.

In FIG. 2, as previously mentioned, the compressor 40 is in fluid communication with each cryopump 10/20/30 via conduit 41. The compressor 40 and each motor 13/23/33 are connected to a control unit 50 via wire means 42. In addition, between the control unit 50 and each motor 13/23/33, there is interposed a current sensor for detecting the amount of current applied to each motor 13/23/33.

Figure 3:
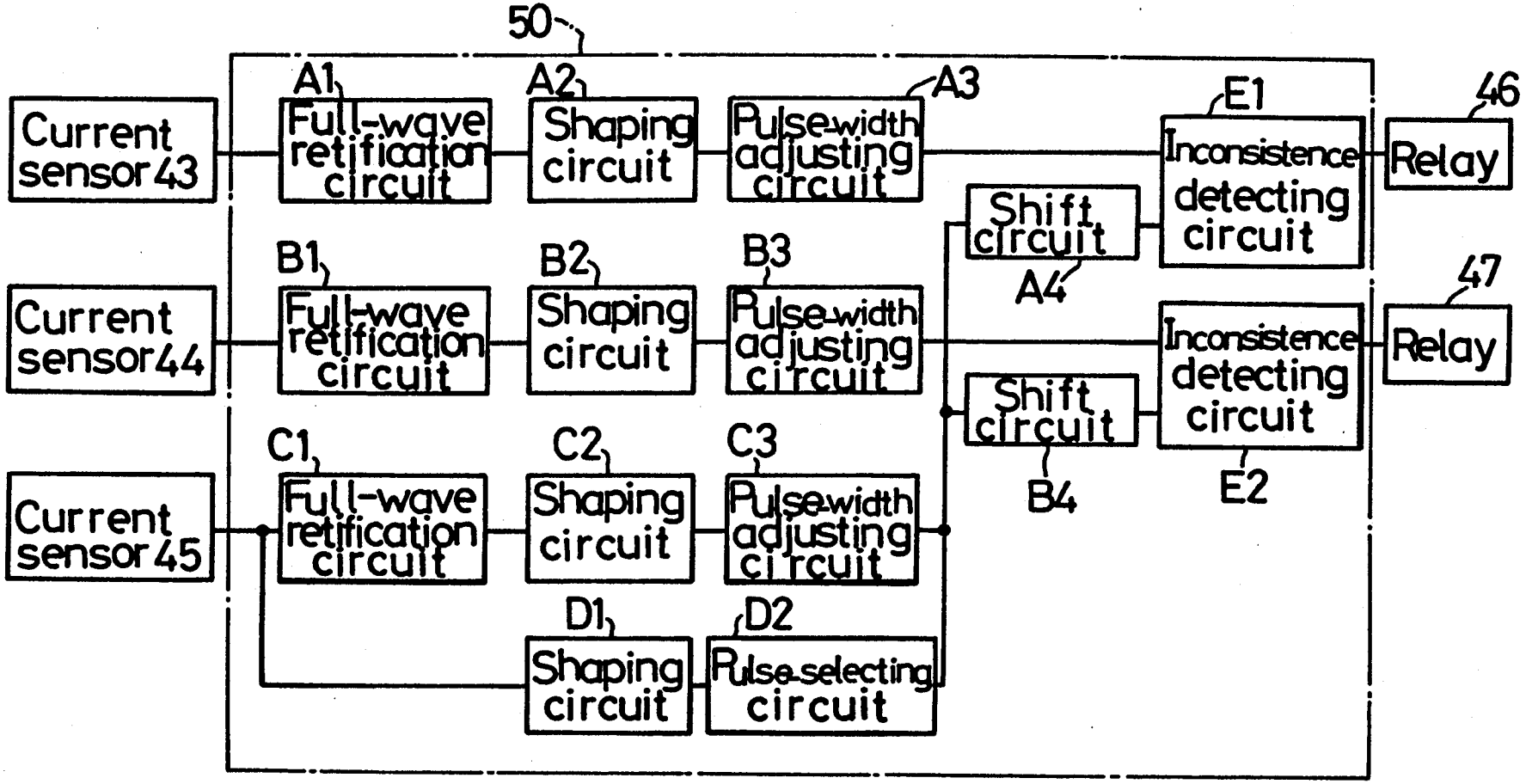
FIG. 3 is a diagram of a control unit for controlling the timing of open/closure of a valve.
Figure 4:
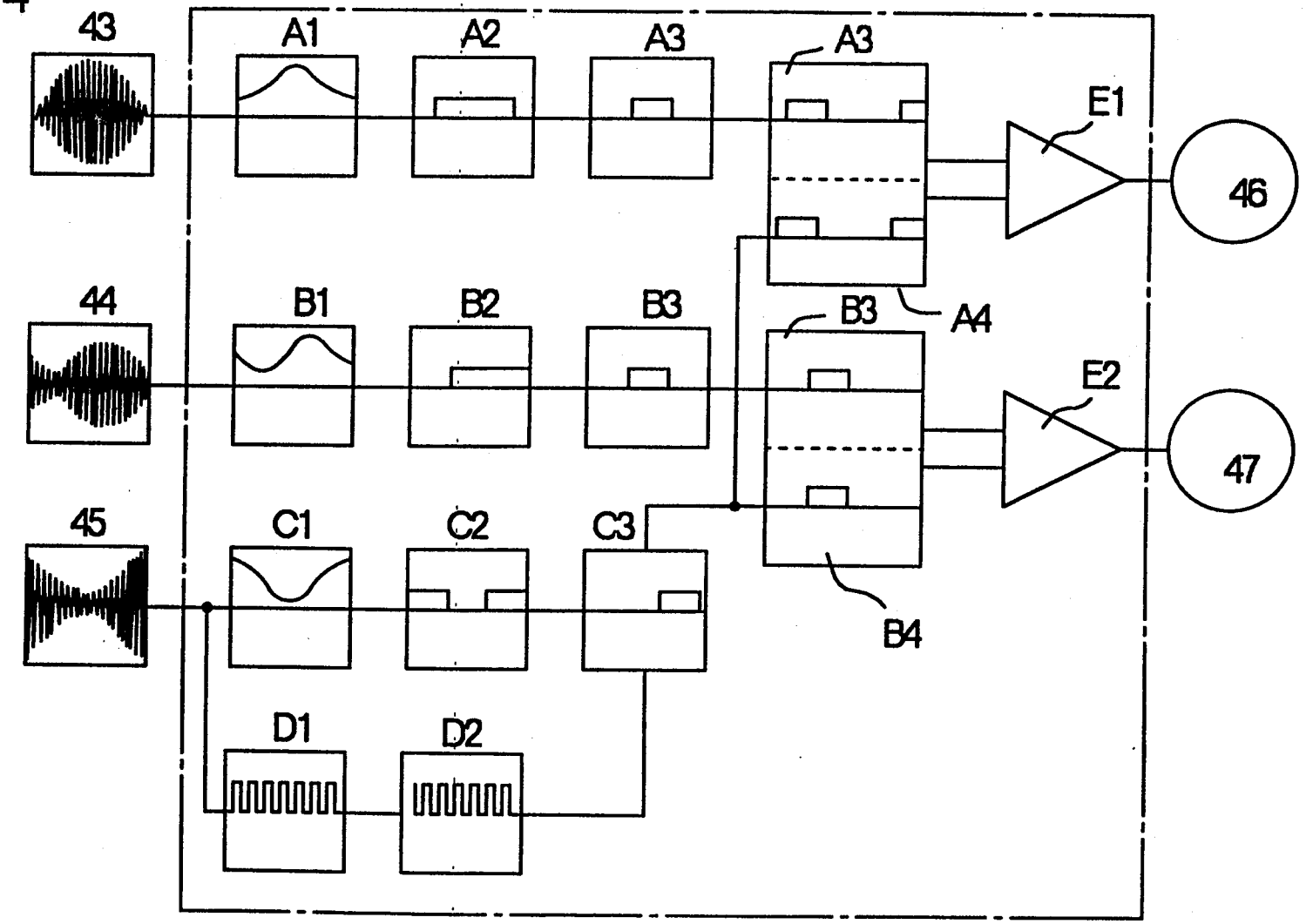
FIG. 4 is a view similar to FIG. 3 but showing the shape of each wave.

In each of FIGS. 3 and 4, there is illustrated an outline of a circuit of the control unit 50. In FIG. 4, each wave-shape is shown for easy understanding. An output terminal of each current sensor 43/44/45 is connected to a full-wave rectification circuit A1/B1/C1 which is of well-known construction and function in order to detect the pulsating wave-shape of current which is being applied to each motor 13/23/33. An output terminal of each full-wave rectification circuit A1/B1/C1 is connected, via each shaping circuit A2/B2/C2, to the corresponding pulse-width adjusting circuit A3/B3/C3. Also, an output terminal of the sensor 45 is connected, via a shaping circuit D1, to a pulse-selecting circuit D2 so that a driving pulse of the motor 33 may be selected. It is noted that, in this embodiment, each motor 13/23/33 is set to have one revolution or rotation per 50 pulses and the change in current to be applied to each motor 13/23/33 is shaped into a pulse signal with a given pulse width in the pulse-width adjusting circuit A3/B3/C3.

Figures 5, 6:
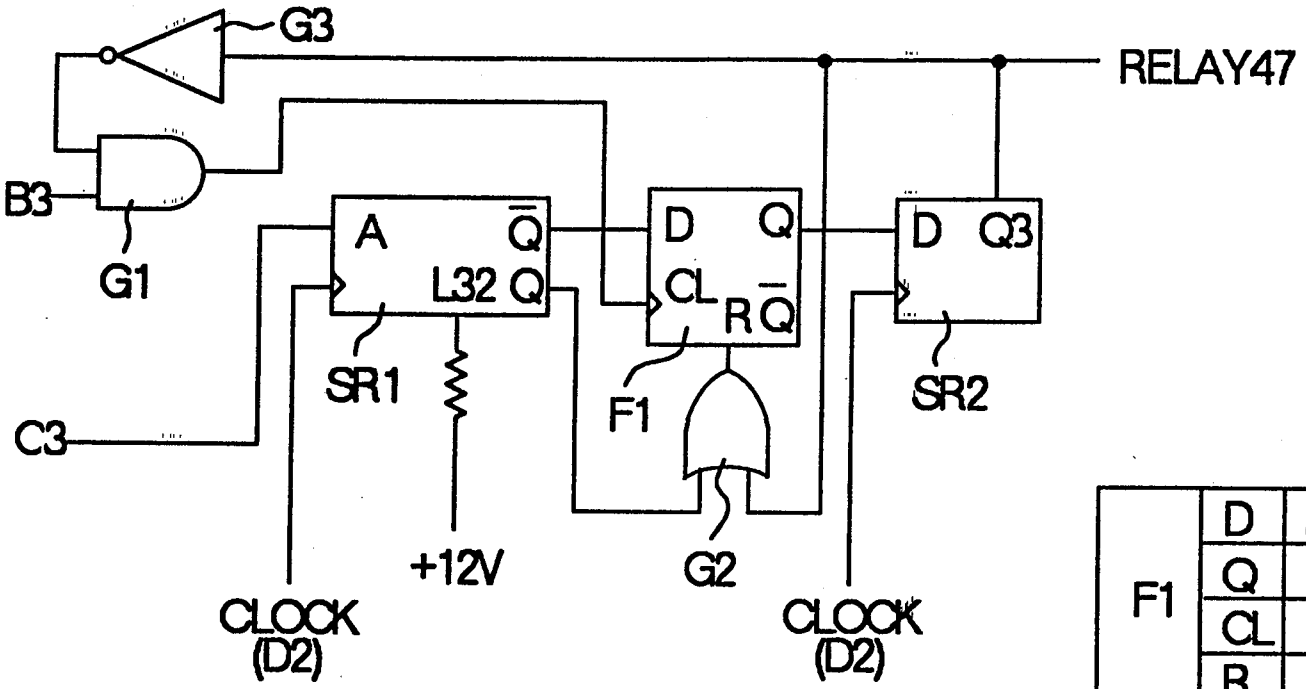
FIG. 5 is an example of a detailed circuit of a main portion of the control unit.
FIG. 6 is a logic-table of the circuit in FIG. 5.

An output terminal of the pulse-width adjusting circuit C3 and an output terminal of the pulse selecting circuit D2 are respectively connected to a shift circuit A4 and a shift circuit B4 both of which are identical in construction and function. As best shown in FIG. 5, the shift circuit B4 includes a shift register SR1 from which a pulse signal is outputted in delay of 32 pulses of the driving pulse on the basis of the output pulse of the pulse-width adjusting circuit C3. Similarly, the shift circuit A4 outputs a pulse signal which is in delay of 16 pulses of the driving pulse on the basis of the pulse-width adjusting circuit B3.

An output terminal of the shift circuit A4 and an output terminal of the shift circuit B4 are connected to an inconsistence detecting circuit E1 and an inconsistence detecting circuit E2, respectively. The circuit E1/E2 controls the relay 46/47 so as to consist the output pulse from the circuit A3/B3 with the delayed pulse from the circuit A4/B4. As is best shown in FIG. 5, the inconsistence detecting circuit E2 includes an AND-circuit G1, and OR-circuit G2, an inverter G3, a flip-flop F1 and a shift register SR2. An inverting terminal $\overline{Q}$ of the shift register SR1 is connected to an input terminal D of the flip-flop F1. The reset terminal R of the flip-flop F1 is connected to an output terminal of the OR-circuit G2. In addition, the input terminal D of the shift register SR2 is connected to the output terminal Q of the flip-flop F1 and a clock terminal CL of the flip-flop F1 is connected to the output terminal of the AND-circuit G1.

The shift register SR2 operates in such manner that an inputted pulse signal to the input terminal D is outputted as a delayed pulse signal by 3 pulses to the relay 47, which is the input terminal of the OR-circuit G2 and the input terminal of the inverter G3. To the input terminal of the AND-circuit G1, there are connected an output terminal of the inverter G3 and the output terminal of the pulse-width adjusting circuit B3. Thus, if an H signal is applied to the input terminal of the flip-flop F1, the output signal of the AND-circuit G1 is inverted from L TO H and an H signal is outputted from the output terminal Q of the flip-flop F1 upon application of an H signal to the clock terminal CL. As a result, the shift register SR2 outputs to the output terminal Q3 a 3 pulse-delayed pulse signal, thereby interrupting the current-supply to the motor 23 after turning-off the relay 47.

In an embodiment in the form of the foregoing construction each motor 13/23/33 for driving the corresponding cryopump 10/20/30 rotates at a constant speed in sychronization with the frequency of the current to be supplied to each motor, which is 50 Hz in this embodiment. The load is each motor 13/23/33 varies during one rotation thereof in accordance with a stroke of the corresponding cryopump 10/20/30. Furthermore, the amount of current through each motor 13/23/33 varies in proportion to the varying load. Thus, by detecting the change in current as each sensor 43/44/45, the operating position of the corresponding cryopump 10/20/30 can be detected. Importantly, each cryopump 10/20/30 is in the compression stroke if corresponding current is at a maximum or peak. Therefore, is an output signal of each pulse-width adjusting circuit A3/B3/C3 is in H-level, the corresponding cryopump 10/20/30 is in its compression stroke.

In this embodiment, a pulse signal delayed by 16 pulses of the driving pulse is generated in the shift circuit A4 on the basis of the outputted pulse from the pulse-width adjusting circuit C3, as a conversion of the current supplied to the cryopump 30 into a pulse signal. The rising from L-level to H-level of the output pulse signal of the pulse-width adjusting circuit A3 is delayed so as to be consisted with the delayed pulse signal in the circuit E1. Similarly, a pulse signal delayed by 32 pulses of the driving pulse is generated in the shift circuit B4 on the basis of the outputted pulse from the pulse-width adjusting circuit C3, and the rising from H-level of the output signal of the pulse-width adjusting circuit B3 is delayed. In detail, the shift circuit B3, the shift circuit B4, the inconsistence detecting circuit E1 and the inconsistence detecting circuit E2 operate in the following manner. With reference to FIGS. 5 and 6, when the pulse signal outputted from the pulse-width adjusting circuit C3 is applied to the input terminal A of the shift register SR1 after initiation or starting of each cryopump, an H-level signal is being outputted from inverting terminal $\overline{Q}$ while the number of the driving pulses is less than 32, thereby outputting an L-level signal from an output terminal Q. At the requisite condition, the outputted pulse signal from the pulse-width adjusting circuit B3 is raised from L-level to H-level, the output signal of the AND-circuit G1 is inverted from L-level into H-level, and an H-level signal is outputted from the output terminal Q of the flip-flop F1 when an H-level signal is applied to the clock terminal CL of the flip-flop F1. Thus, an H-level signal, which is in the form of the pulse signal delayed by 3 pulses, is outputted from the shift register SR2 to the output terminal Q3. Thus, relay 47 is turned off, and the current to the motor 23 is interrupted, and the rising of the output pulse signal of the pulse-width adjusting circuit B3 is delayed.

When an H-level signal is outputted from the output terminal Q3 of the shift register SR2, the output signal of the OR-circuit G2 becomes an H-level signal, thereby inputting an H-level signal to the reset terminal R of the flip-flop F1. Then, the flip-flop F1 is reset, the outputted signal from the output terminal Q thereof becomes L-level, and a 3-pulse delayed L-level signal is outputted from the out-put terminal Q3 of the shift register SR2. Simultaneously, and L-level signal is outputted from the output terminal of the inverter G3, and the resulting signal is inputted to the clock terminal CL of the flip-flop F1.

By repeating the foregoing operation, the relay 47 is turned on and off alternatively. The action of the relay 47 consists the rising of output pulse signal (H-level) of the pulse-width adjusting circuit B3 with the rising of delayed pulse signal (H-level) which is delayed by 32 pulses with respect to the reference pulse signal from the pulse-width adjusting circuit C3, whereby an L-level signal is outputted from the inverting terminal $\overline{Q}$ of shift register SR1 as soon as H-level signal is inputted to the clock terminal CL of the flip-flop F1. In addition, similarly, the shift circuit A4 and the inconsistence detecting circuit E1 consist the rising of the outputted pulse signal (H-level) from the pulse-width adjusting circuit A3 with the rising of the pulse signal which is delayed by 16 pulses with respect to the reference pulse signal from the pulse-width adjusting circuit C3.

Consequently, due to the operation of the control unit 50, H-levels of the pulse signal of each pulse-width adjusting circuit A3/B3 appear with constant cycle during L-level condition of the output pulse signal of the pulse-width adjusting circuit C3, which is in equivalent to a span between two adjacent maximum values of the current to the motor 33 for driving the cryopump 30.

As a further advantage, should be noted that since each cryopump is out of mechanical contact with the current detecting sensor and the relays 46 and 47, there are no problems such as gas leakage or mechanical malfunction.

Although certain specific embodiments of the present invention have been shown and described, it is obvious that many modifications thereof are possible. The present invention is not intended to be restricted to the exact showing of the drawings and description thereof, but is considered to include reasonable and obvious equivalents.

What is claimed is:

1. A multi-headed cryopump apparatus comprising:

a plurality of cryopumps;

a common compressor connected to each of the plurality cryopumps;

a plurality of valve means each of which is interposed between each cryopump and the compressor;

a plurality of motors for driving a corresponding cryopump;

a plurality of current detecting sensors for detecting the current supplied to a corresponding motor; and a control unit for controlling the operation of each valve means on the basis of the result of each current detecting sensor in such manner that the plural valve means operate in turn with a constant cycle.

2. A multi-headed cryopump according to claim 1, wherein the control unit applies and interrups the electrical current to each motor in such manner that the maximum values of the detected current by the current detecting sensor appear with a constant cycle.

3. A multi-headed cryopump according to claim 1, wherein each cryopump is operated according to Gifford-McMahon cycle.

* * * * *